US005494105A

United States Patent [19]

Morris

[11] Patent Number: 5,494,105

[45] Date of Patent: Feb. 27, 1996

[54] METHOD AND RELATED SYSTEM FOR OPERATING A DOWNHOLE TOOL

[75] Inventor: Arthur J. Morris, Magnolia, Tex.

[73] Assignee: Camco International Inc., Houston, Tex.

[21] Appl. No.: 328,737

[22] Filed: Oct. 25, 1994

[51] Int. Cl.[6] ..... E21B 47/09

[52] U.S. Cl. ..... 166/255.1; 166/64; 166/66; 166/72

[58] Field of Search ..... 166/255, 64, 381, 166/72, 66

[56] References Cited

U.S. PATENT DOCUMENTS

| | | | |
|---|---|---|---|
| 4,862,958 | 9/1989 | Pringle | 166/72 |
| 5,188,174 | 2/1993 | Anderson, Jr. et al. | 166/85 X |
| 5,251,493 | 10/1993 | Sipos | 73/862.584 |
| 5,309,988 | 5/1994 | Shy et al. | 166/72 |
| 5,316,094 | 5/1994 | Pringle | 175/74 |
| 5,373,898 | 12/1994 | Pringle | 166/72 |
| 5,394,951 | 3/1995 | Pringle et al. | 175/61 |

*Primary Examiner*—Hoang C. Dang

[57] ABSTRACT

A method and related system for operating a downhole tool connected to coiled tubing comprises introducing the tool and the coiled tubing into a wellbore providing to the earth's surface a signal indicative of compression, tension and/or impact forces applied to the tool, using the signal to determine at the earth's surface the location of the tool within the wellbore, and then operating the tool.

10 Claims, 3 Drawing Sheets

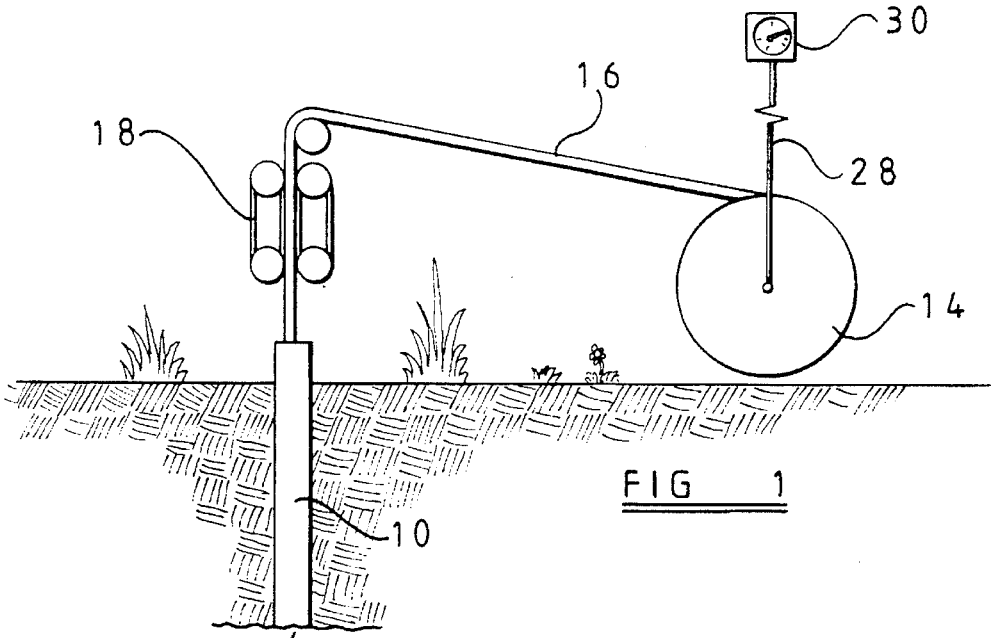
FIG 1
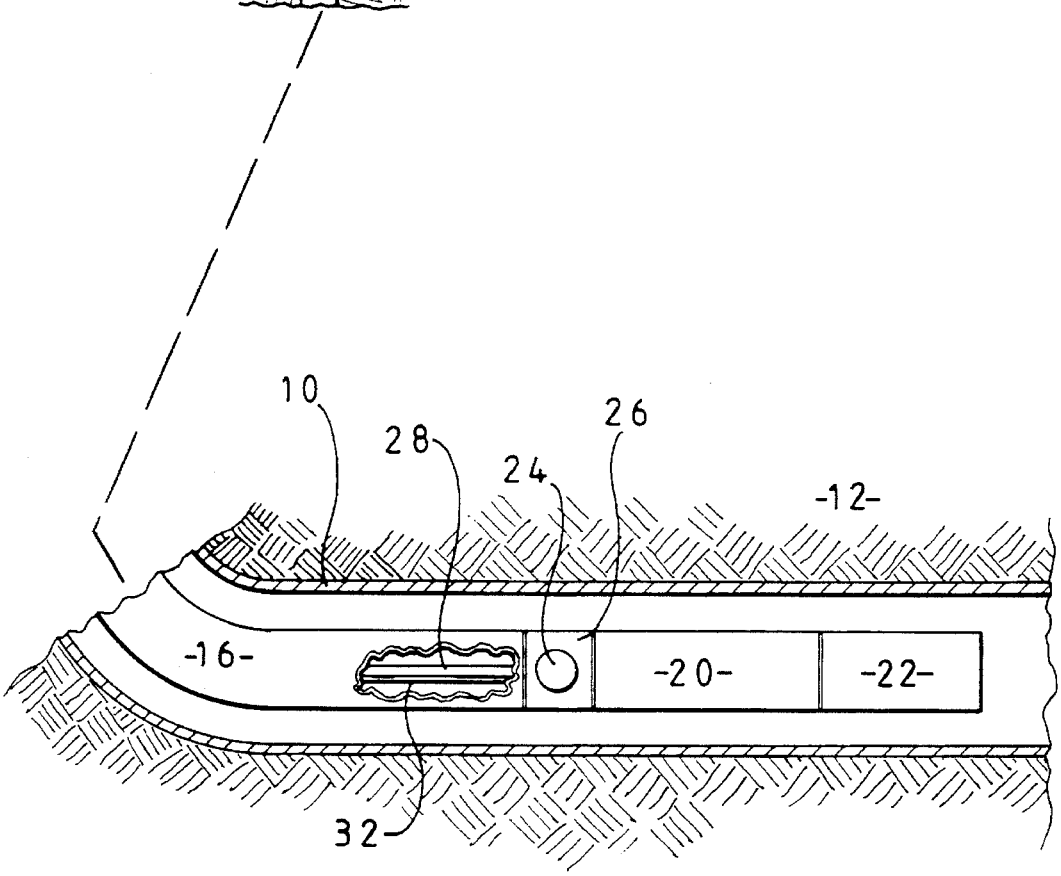

METHOD AND RELATED SYSTEM FOR OPERATING A DOWNHOLE TOOL

BACKGROUND OF THE INVENTION

1. Field of the Invention

The present invention relates to methods and related systems for operating a downhole tool connected to coiled tubing and, more particularly, to such methods and related systems that enable the operator at the earth's surface to know the exact location of the tool within a wellbore and to determine the forces acting on such tool.

2. Description of Related Art

Knowing the location of and the magnitude and direction of forces acting on a downhole tool within a wellbore is crucial to the proper operation of tools and devices that must interact with in-place wellbore equipment. For example, those skilled in the art know that an operator at the earth's surface must be able to know the location of the lower end of a kickover tool in relation to an existing side pocket mandrel, as well as direction of the forces applied thereto when the kickover tool is introduced into the wellbore. If the kickover tool is operated in an incorrect location or excessive force is applied to it within the wellbore, damage to the tool and/or the wellbore may result. More importantly, the recovery of valuable wellbore hydrocarbons may be abated if the tool and/or the wellbore is damaged.

Continuing the above example, when a kickover tool is run by gravity on a wireline the operator generally knows the location of the kickover tool within the wellbore by reading an indicator of the footage of wireline that has been introduced into the wellbore, and/or by watching a weight indicator for an increase or a decrease in wireline tension to determine if the tool has been properly located or set within the wellbore. The kickover tool has a finger adapted to engage a detent within the side pocket mandrel, and is activated by a predetermined strain force or an impact force. Standard procedure with this type of wireline operation is to unroll sufficient wireline so that the kickover tool is lowered past the detent within the side pocket mandrel. Then, the wireline is slowly retrieved while a wireline load indicator is closely monitored at the earth's surface. When the kickover tool's finger has become engaged in the detent, the load applied to the wireline will sharply increase, which will give the operator a positive indication that the kickover tool is properly oriented and landed within the side pocket mandrel. Thereafter, the operator can utilize wireline jars to repeatedly apply controlled impact forces to the kickover tool to activate it and, for example, set a gas lift valve within the side pocket mandrel. A similar procedure can be used to set wireline locks, sliding sleeves, operate running, pulling and fishing tools, or numerous other wireline operations which require precise location and application of impact forces.

In wellbores where such wireline operations cannot be used, such as in deviated or horizontal wellbores, coiled tubing is now being used because of its relative rigidity which allows it to be pushed further into the wellbore, and especially into horizontal sections of the wellbore. However, due to the rigidity of coiled tubing, the operator may not know the exact location of the end of the coiled tubing and the precise location of the tool within the wellbore, nor the forces generated at the lower end of the coiled tubing. While coiled tubing is more rigid than wireline, it is inherently ductile and because of this coiled tubing will tend to snake or form long helical loops within the wellbore when a downward force (ie. a compressive load) is applied thereto. The result is that the operator will know how many feet of coiled tubing has been introduced into the wellbore, yet the operator will not know the exact location of the end of the coiled tubing. Sometimes the best location estimate of even skilled coiled tubing operators is several hundred feet in error. This helical looping also masks the forces generated at the lower end of the coiled tubing so that the operator can easily overstress a downhole device.

There is a need for a method and a related system for determining at the earth's surface the exact location of the end of coiled tubing within the wellbore and the magnitude and the direction of forces acting thereupon, and which can be used in vertical wellbores, as well as deviated and horizontal wellbores.

SUMMARY OF THE INVENTION

The present invention has been contemplated to overcome the foregoing deficiencies and meet the above described needs. Specifically, the present invention is a method and related system for operating a downhole tool, such as a power actuating tool, connected to coiled tubing. The method comprises introducing the tool and the coiled tubing into a wellbore, and providing to the earth's surface a signal indicative of forces applied to the tool. The signal is the result of compression, tensile and/or impact forces acting on a load cell, with the signal from the load cell being sent to the earth's surface. The operator can then determine the tool's location and forces acting thereupon, so that the tool can be operated as needed or retrieved.

BRIEF DESCRIPTION OF THE DRAWINGS

FIG. 1 is side elevational view of one preferred embodiment of a system for measuring forces of the present invention, connected to a string of coiled tubing and disposed within a wellbore in accordance with one preferred method of the present invention.

DETAILED DESCRIPTION OF THE PREFERRED EMBODIMENTS

Figure 2:
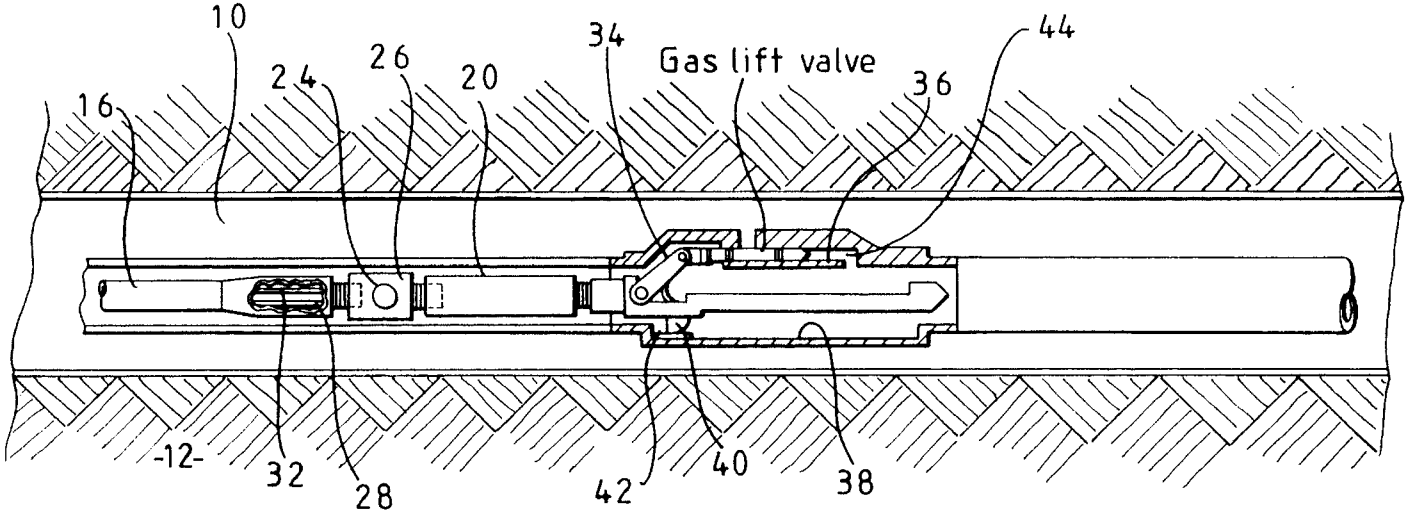
FIG. 2 is a side elevational view of a kickover tool connected to the end of a downhole tool in accordance with one preferred method of the present invention.

The present invention is a method and related system for determining the magnitude and direction of forces acting upon a lower end of a string of coiled tubing, as well as a method and related system for determining the location within a wellbore of a lower end of a string of coiled tubing. As has been briefly described above, the present invention also is a method and related system for operating a downhole tool, such as a power actuating tool, connected to coiled tubing. This method generally comprises introducing the tool and the coiled tubing into a wellbore, providing to the earth's surface a signal indicative of magnitude and direction of forces applied to the tool, using the signal to determine at the earth's surface the location of the tool within the wellbore, and then operating the tool.

For the purposes of the following discussion the term "downhole tool" will mean a downhole actuating tool of the type that operates or effects some change in the condition or configuration of a downhole device, which is either connected to the tool or disposed within the wellbore. The downhole tool can be a firing mechanism for a perforating gun, a jar mechanism, and a power actuation tool that jars or longitudinally extends upon command from the earth's surface. More specifically and most preferably, the downhole tool is a power actuating tool as disclosed in U.S. Pat. No. 4,862,958, which is commonly assigned hereto and which is incorporated herein by reference.

The term "downhole device" means any device that is operated by or is changed in condition or configuration by the downhole tool. Such a device can be a scale remover, a paraffin cutter, a borehole reamer, a sidewall coring tool, a drill bit, and the like. Also, the device can be any suitable completion device, such as a packer, a sliding sleeve, a locking mechanism, a plugging mechanism, and a valve installation mechanism. The present invention can also be used in conjunction with running tools, pulling tools, fishing tools, jar tools, and the like. One preferred use is with a kickover tool used to install a gas lift valve in and retrieve the gas lift valve from a side pocket mandrel.

One preferred embodiment of the system of the present invention is shown in FIG. 1 where a wellbore casing or production tubing 10 is provided within a subterranean formation 12, as is well known to those skilled in the art. A reel 14 of coiled tubing 16 is provided adjacent the well and is installed into the production tubing 10 and retrieved there from by the operation of a coiled tubing injector unit 18, as is well known to those skilled in the art. A downhole tool 20, such as a downhole power actuation tool is operatively connected to a lower end of the coiled tubing 16. A downhole device 22, such as a kickover tool (shown in FIG. 2) is operatively connected to the lower end of the tool 20.

For the purposes of this discussion, the terms "upper" and "lower" and "upwardly" and "downwardly" are relative terms to indicate position and direction of movement in easily recognized terms. Usually, these terms are relative to the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

A load cell 24 is connected to a lower end of the coiled tubing 16, is connected to or disposed within the tool 20 or, preferably, is disposed within a housing or sub 26 connected between the tool 20 and the lower end of the coiled tubing 16. Further, the load cell 24 can be connected or disposed within the device 22 or mounted within the sub 26 with the sub 26 connected between the tool 20 and the device 22. A preferable load cell 24 for use with the present invention is any device that generates a signal indicative of the magnitude of the forces applied to the lower end of the coiled tubing 16, the tool 20, and/or the device 22. Preferably, the load cell 24 also indicates the type or "direction" of the forces. The forces measured are compression, tensile and/or impact forces, and preferably compression and tensile. A load cell 24 for use in the present invention is an electronic transducer-type load cell that generates its own power or receives electrical power from an internal battery, another downhole device or the earth's surface through a conductor 28. The load cell 24 sends its indicative signal back to the earth's surface through the same or separate conductors 28. As shown in FIG. 1, the conductors 28 are disposed within the interior of the coiled tubing 16, but the conductors 28 can be banded or strapped to the outside of the coiled tubing 16 if desired. The conductors 28 are operatively connected at the earth's surface to an indication device 30, which is any device that provides the operator with a visual and/or audible indication of the magnitude and/or the direction of the forces measured by the load cell 24. Preferably, the indication device 30 is an analog or a digital display, such as a dial or a L.E.D. or a L.C.D.

An alternate embodiment of the load cell 24 comprises a load cell that operates by the application of hydraulic pressure to generate a hydraulic signal that is transmitted to the earth's surface and to the indication device 30 by way of mud pulse telemetry or through a conduit 32, which is disposed within or strapped to the outside of the coiled tubing 16. It should be noted that the conduit 32 is also primarily used to provide hydraulic fluid to operate the tool 20, as will be described in detail below.

As described briefly above, the load cell 24 can be used to determine the forces acting upon a lower end of coiled tubing 16 without the need for the use of the tool 20 and/or the device 22. In this case, the housing 26 is connected to a lower end of the coiled tubing 16 and then run into the well until a lower end of the coiled tubing 16 and the housing 26 encounter an obstruction, a piece of wellbore equipment, or a device in the wellbore. The coiled tubing operator will then be able to determine at the earth's surface from the signal how much force is required to move the obstruction, and, for example, how much force is needed to operate the wellbore equipment or device. Also, as briefly described above, the load cell 24 can be used to determine the location of the lower end of the coiled tubing 16 within a wellbore without the need for use of the tool 20 and/or the device 22. In this case, the housing 26 with the load cell 24 is connected to a lower end of the coiled tubing 16 and is inserted into the wellbore. When the lower end of the coiled tubing 16 encounters an obstruction or a piece of wellbore equipment within the wellbore, then the signal will provide a force indication at the surface which can give the operator a positive indication that the lower end of the coiled tubing 16 has reached a known location within the wellbore; i.e. where the obstruction is or where the piece of wellbore equipment is. Then, fluids can be introduced into the coiled tubing to wash away the obstruction, for example.

An example of the use of one preferred method and related system of the present invention is shown in FIG. 2, where a power actuation tool 20, of the type disclosed in U.S. Pat. No. 4,862,958, is used to operate a commercially available kickover tool 34 to set a gas lift valve within a side pocket mandrel 36. First, the operator connects the kickover tool 34 to the power actuation tool 20. The conductor(s) 28 and conduit(s) 32 needed for the operation of the tool 20 and to provide the signal to the surface are preferably disposed within the coiled tubing 16. The tool 20, and the sub 26 if used is connected to the lower end of the coiled tubing 16. The upper end of the conductor(s) 28 and/or the conduit(s) 32 are operatively connected to appropriate control mechanisms (not shown) and to the indication device 30.

The injector unit 18 is activated to move the coiled tubing 16, the power actuation tool 20 and the kickover tool 34 downwardly into and through the production tubing 10. The operator will know ahead of time the approximate location within the production tubing 10 of the side pocket mandrel 36, so the operator will monitor the number of feet of coiled tubing 16 introduced within the production tubing 10, as well as the indication device 30. A slowing of the introduction rate and an indicated increase in the compression forces from the load cell 24 will provide an indication to the operator that the end of the tool string is entering a highly deviated or horizontal section of the wellbore. The operator continues the introduction of the coiled tubing 16 into the production tubing 10 by way of the injector unit 18.

A downhole thruster unit (not shown) can be attached to the tool 20 to assist in moving the tool 20 through the horizontal sections. A preferred downhole thruster unit is disclosed in U.S. Pat. No. 5,316,094, which is commonly assigned hereto and is herein incorporated by reference. With the downhole thruster unit, pads thereon are extended to grip the interior surface of the production tubing 10 and a lower section of the unit is extended, and then the pads are released to move the unit and the tool 20 into the production tubing.

The operator continues to monitor the length of coiled tubing 16 inserted and the force indication device 30 for any indication that the end of the kickover tool 34 has encountered the side pocket mandrel 36. This indication can be an increase in the compression force as the end of the kickover tool 34 enters an internal channel 38 of the side pocket mandrel 36. On the other hand, a relatively large increase in the compression forces will be an indication that the lower end of the kickover tool 34 is not properly aligned with the side pocket mandrel 36 or it has encountered an obstruction. With this relatively large increase in compression forces, the operator can quickly cease the advancement of the coiled tubing 16 to prevent damage to the tool 20 and the device 22 and to take corrective action.

As the coiled tubing 16 and the tool string is advanced, a spring biased finger 40 on the kickover tool passes over a detent or recess 42 within the side pocket mandrel 36. The advancement of the coiled tubing 16 is ceased, and then reversed. The finger 40 will then land into the detent 42, and will be held therein. Tensile forces will increase so that the load cell 24 will generate a signal indicative of an increase in the tensile forces, which will be a positive indication to the operator that the kickover tool 34 has properly set within the side pocket mandrel 36. Loads on the kickover tool are then decreased by letting the coiled tubing 16 go slightly slack. The power actuation tool 20 is activated, as is well known, to cause the gas lift valve to be moved into a polished bore 44 in the side pocket mandrel, as is well known to those skilled in the art.

Figure 3:
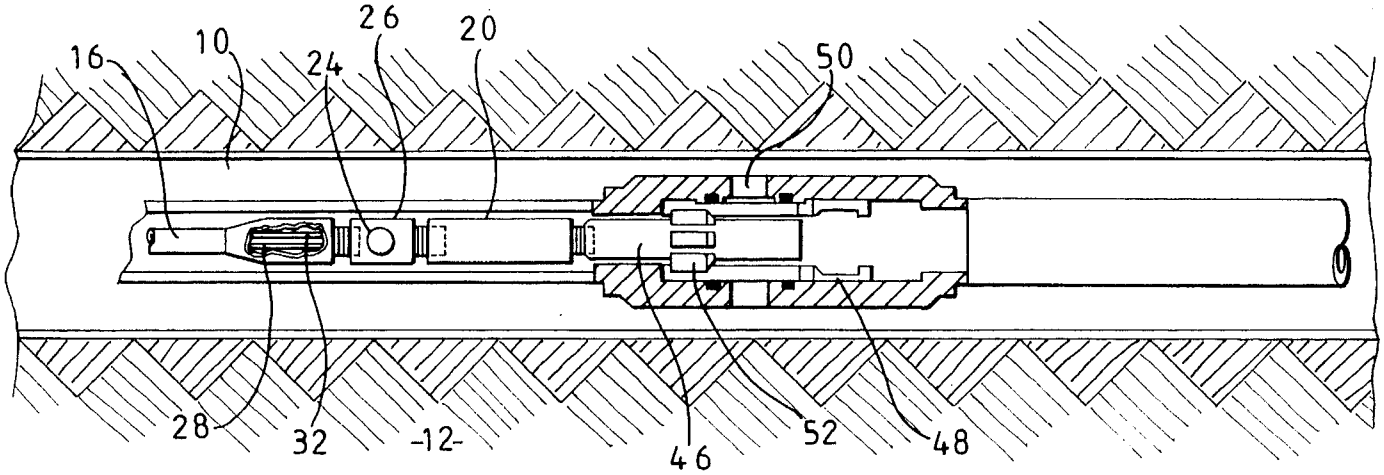
FIG. 3 is a side elevational view of a shifting tool connected to the end of a downhole tool in accordance with one preferred method of the present invention.

In another example, a preferred method and related system of the present invention is used to operate a commercially available shifting tool 46 and a sliding sleeve 48, as shown in FIG. 3. The present invention can be used to either open or close the sliding sleeve 48, depending upon the operational needs; however, for the purpose of this discussion it is assumed that the shifting direction is "downward" to open radial ports 50 and "upward" to close such ports 50 within the sliding sleeve 48. The operator will connect the shifting tool 46 to a lower end of the coiled tubing 16, the sub housing 26 or, preferably, the actuating tool 20. The coiled tubing 16 and associated tools are introduced into the wellbore, as described previously. When spring loaded keys 52 on the shifting tool 48 encounter and become locked within corresponding openings (not shown) within the sliding sleeve 48, the advancement of the coiled tubing 16 is prevented. A sudden increase in the indicated compression load provides the operator with an indication at the earth's surface that the shifting tool 46 has become properly landed within the sliding sleeve 48. The operator then causes the coiled tubing 16 to be withdrawn a relatively short distance to remove any compressive force on the shifting tool 46. The power actuation tool 20 is activated to cause the sliding sleeve to move to open the ports 50. The closing of the ports 50 is accomplished in basically the same manner in reverse, except that the shifting tool 46 is reversed and is connected "backwards", and a sudden increase in tensile force will indicate that the shifting tool 46 has been properly landed. Then, actuation of the tool 20 causes the sliding sleeve to retract to close the ports 50.

Figure 4:
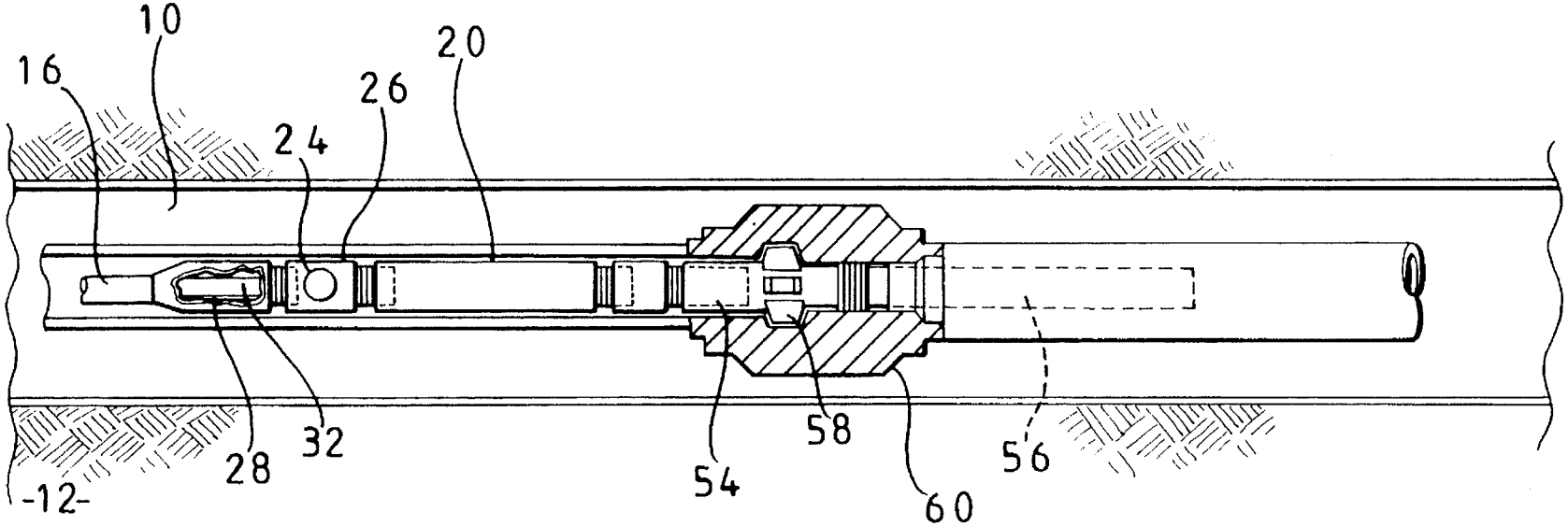
FIG. 4 is a side elevational view of a pulling tool connected to the end of a downhole tool in accordance with one preferred method of the present invention.

In another example, a preferred method and related system of the present invention is used to set and retrieve a flow control device, as shown in FIG. 4. A locking device 54 retains any suitable flow control device 56, such as a safety valve, a blanking plug and a standing valve, as are all well known to those skilled in the art. In use, the flow control device 56 is connected to the locking device 54, which in turn is connected to a lower end of the coiled tubing 16, the sub 26 or, preferably, to the power actuation tool 20. Also, preferably, the locking device 56 is connected to a running tool or a pulling tool, as are well known to those skilled in the art. As the coiled tubing 16 is advanced into the wellbore, keys 58 on the locking device 56 contact openings or annular recesses/restrictions (often referred to as "no goes") within a landing nipple 60, and thereby stop the advancement of the coiled tubing 16. A sudden increase in the compression force will provide an indication to the operator that the locking device 54 has been properly landed in the nipple 60. The power actuation tool 20 is activated to set the locking device 54 and thereby be disconnected so the flow control device 56 and the locking device 54 are properly set and left within the wellbore. Retrieval of the flow control device 56 is basically the same process in reverse, but with the use of a pulling tool in place of the running tool. Additionally, a lost or stuck pipe or tool can be retrieved from the wellbore by use of a fishing tool connected to the end of the coiled tubing 16, to the sub housing 26 or to the power actuation tool 20. Once the operator receives an indication that the fishing tool has encountered the lost or stuck pipe or tool, conventional "fishing" operations can be commenced with the operator being able to monitor the exact magnitude and direction of forces applied to the downhole tools.

The operation of the present invention provides an important control ability which has heretofore been missing with coiled tubing. The operator now can know exactly where the end of the tool string is in relation to existing wellbore tools and devices. Additionally, the present invention enables the operator to know if the downhole tools are in compression and/or tension and the magnitude thereof to prevent overstressing downhole tools and devices.

Whereas the present invention has been described in relation to the drawings attached hereto, it should be understood that other and further modifications, apart from those shown or suggested herein, may be made within the scope and spirit of the present invention.

What is claimed is:

1. A method of determining the location within a wellbore of a lower end of a string of coiled tubing, comprising:

(a) connecting a load cell adjacent a lower end of a string of coiled tubing;

(b) introducing the load cell and the coiled tubing into a wellbore;

(c) providing to the earth's surface a signal indicative of a force applied to the lower end of the coiled tubing; and (d) using the signal to determine at the earth's surface the location of the lower end of the coiled tubing within the wellbore.

2. The method of claim 1 wherein the signal is an electrical signal transmitted through an electrical conductor to an indication device at the earth's surface.

3. The method of claim 2 wherein the signal is transmitted through an electrical conductor disposed within the coiled tubing.

4. The method of claim 2 wherein the signal is transmitted through an electrical conductor attached to an exterior surface of the coiled tubing.

5. The method of claim 1 wherein the signal is a hydraulic signal provided through a conduit to an indication device at the earth's surface.

6. The method of claim 1 wherein the signal is indicative of compression forces applied to the lower end of the coiled tubing.

7. The method of claim 1 wherein the signal is indicative of tensile forces applied to the lower end of the coiled tubing.

8. The method of claim 1 wherein the signal is indicative of impact forces applied to the lower end of the coiled tubing.

9. The method of claim 1 wherein the location within the wellbore of the lower end of the coiled tubing is determined by: (i) pushing a device connected to the coiled tubing past a set location within the wellbore, (ii) pulling the device until a portion of the device engages a cooperative mechanism at the set location within the wellbore, and (iii) monitoring at the earth's surface a signal indicative of tensile forces to indicate that the device has been engaged at the set location.

10. A system for determining the location within a wellbore of a lower end of a string of coiled tubing, comprising:

a housing adapted for connection to a string of coiled tubing adjacent a lower end thereof;

load cell means disposed within the housing for measuring magnitude and direction of forces applied to coiled tubing;

means for providing to the earth's surface a signal indicative of the magnitude and the direction of the forces applied to the coiled tubing; and means using the signal for providing at the earth's surface an indication of the location of the lower end of the coiled tubing within the wellbore.

* * * * *